United States Patent [19]

Honma

[11] Patent Number: 4,749,091

[45] Date of Patent: Jun. 7, 1988

[54] SHELF PLATE ADAPTED FOR MOUNTING ON AN OFFICE MACHINE

[75] Inventor: Tomio Honma, Kawasaki, Japan

[73] Assignee: Duplo Seizo Kabushiki Kaisha, Tokyo, Japan

[21] Appl. No.: 32,482

[22] Filed: Mar. 30, 1987

[30] Foreign Application Priority Data

Dec. 5, 1986 [JP] Japan ..... 51-186758[U]

[51] Int. Cl.[4] ..... A47F 5/08

[52] U.S. Cl. ..... 211/90; 248/118

[58] Field of Search ..... 211/90, 88, 94, 153; 248/118.1, 118, 221.3, 222.1; 108/108; 24/616, 615

[56] References Cited

U.S. PATENT DOCUMENTS

| | | | |
|---|---|---|---|
| 399,266 | 3/1889 | Hull | 248/118 X |
| 2,914,191 | 11/1959 | Bowden et al. | 211/153 |
| 4,482,064 | 11/1984 | Berbe et al. | 248/118 X |
| 4,543,692 | 10/1985 | Ode et al. | 24/616 |
| 4,545,554 | 10/1985 | Latino et al. | 248/118.1 |
| 4,667,378 | 5/1987 | Sturm | 24/616 |

FOREIGN PATENT DOCUMENTS

| | | | |
|---|---|---|---|
| 207799 | 3/1909 | Fed. Rep. of Germany | 248/118.1 |

*Primary Examiner*—Ramon S. Britts
*Assistant Examiner*—Sarah A. Lechok Eley
*Attorney, Agent, or Firm*—Christensen, O'Connor, Johnson & Kindness

[57] ABSTRACT

A shelf plate is adapted for use with an office machine having an insertion slot for receiving the plate. The plate is formed of a synthetic resin in a generally planar surface and includes integrally formed, laterally offset leaf spring portions that extend from each side of the plate in a direction opposite to that in which the plate is normally inserted into the office machine. Each of the leaf spring portions includes on its top surface a groove defined by a first and a second stepped portion that is adapted to engage locking edges on the insertion slot in the framework of the office machine. The inherent elasticity of the leaf spring portions biases the groove into engagement with the locking edge. A force may be exerted on the extending free ends of the leaf spring portions to disengage the groove from the locking edge for removal of the shelf plate from the office machine.

3 Claims, 2 Drawing Sheets

SHELF PLATE ADAPTED FOR MOUNTING ON AN OFFICE MACHINE

TECHNICAL FIELD

The subject invention generally relates to a shelf plate mounting mechanism, and more particularly to a shelf plate adapted to be mounted in an insertion slot formed on an office machine.

BACKGROUND OF THE INVENTION

Shelves that are mounted on office machines such as printers or sorters should, for convenience of transport, storage, or repair, be easily mounted and dismounted from the body of the office machine. For this reason, most conventional shelf plate mounting mechanisms have been of the type in which the plate is merely inserted into an insertion slot formed in the body of the office machine. Shelf plate mounting mechanisms have also been employed in which screws are used to ensure a connection between the body of the machine and the shelf plate.

Of these two conventional approaches to mounting a shelf plate, the first has a disadvantage in that the shelf plate is apt to accidentally fall off when stacks of paper sheets are removed from the shelf. The second approach involving the use of screws to attach the shelf plate is also undesirable in that the operation of mounting and dismounting the plate is troublesome.

In view of these disadvantages of the prior art, it is an object of the present invention to provide a shelf plate which can be mounted on the body of an office machine in an improved manner to facilitate the operation of mounting and dismounting the plate, and at the same time, to prevent the plate from accidentally falling off the machine. This and other objects of the invention will be apparent to those skilled in the art from the disclosure of the preferred embodiment which follows hereinbelow and the attached drawings.

SUMMARY OF THE INVENTION

The above-mentioned object of the invention is obtained by a shelf plate that is adapted to be mounted in an insertion slot formed through a body of an office machine. The shelf plate comprises a generally planar plate including an integral leaf spring portion formed along one side. The leaf spring portion extends in a direction opposite to that in which the shelf plate is inserted into the body of the office machine and is laterally offset from a main part of the plate by a notch. During insertion of the plate into the slot formed in the machine, the leaf spring portion is elastically displaced by a locking edge formed on the insertion slot. The leaf spring portion includes a first step portion formed on its surface that is adapted to engage the locking edge of the insertion slot upon full insertion of the plate into the slot. An extending end of the leaf spring portion functions as a manipulator on which a force can be exerted to disengage the first stepped portion of the leaf spring portion from the locking edges of the insertion slot, for removal of the shelf plate.

In a further embodiment, the shelf plate includes a leaf spring portion on both side of the plate. In an additional embodiment, a second stepped portion is formed on the leaf spring portion adjacent its extending end, and together with the first stepped portion, defines a groove that is adapted to engage the locking edge of the insertion slot upon full insertion of the plate into the slot formed in the office machine.

DETAILED DESCRIPTION OF THE PREFERRED EMBODIMENT

Figure 1:
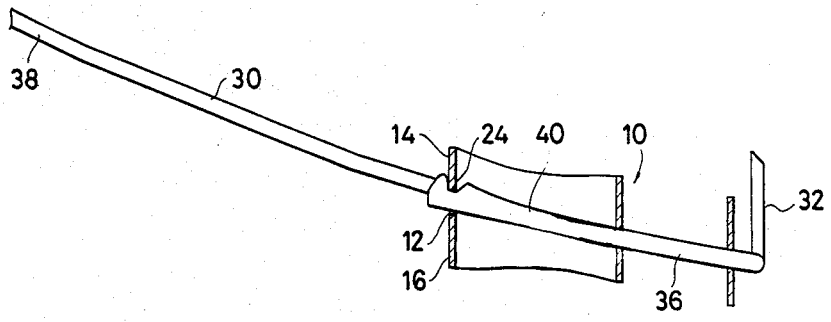
FIG. 1 is a sectional side view illustrating the mounting mechanism for the shelf plate of the present invention.
Figure 2:
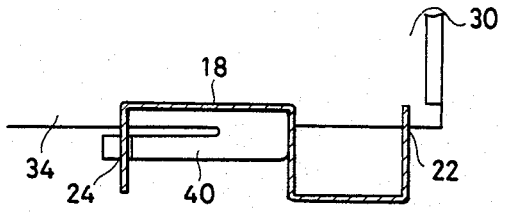
FIG. 2 is a sectional plan view of the shelf plate.

As shown in FIGS. 1 and 2, a body of an office machine 10 is provided on one side with an insertion slot 12 for a shelf plate 30. Slot 12 represents a configuration defined by upper and lower frame members 14 and 16 disposed on opposite sides of the office machine body 10 (only one side is shown in FIG. 2); frame members 14 and 16 engage both sides edges 34 of shelf plate 30, but permit an intermediate portion thereof, including a stand-up portion 32 disposed on the inner ends of shelf plate 30, to pass through without interfering with insertion slot 12.

FIG. 2 shows the upper frame 14 of the insertion slot 12 as seen in a sectional plan view. The lower frame 16 also has a similar configuration to that of the upper frame 14. Both frames 14 and 16 are made of steel plates bent as shown and operative to restrain each of the side edges 34 of the shelf plate 30 between an inverted "U"-shaped portion 18 on the inlet side, and a frame end portion 22 on the interior side of insertion slot 12, from above and below, respectively. The "U"-shaped portion 18 of upper frame 14 is formed along the leg on the inlet side with a locking edge 24 which extends downwardly relative to the rest of the "U"-shaped portion 18 so as to engage a leaf spring portion 40 of shelf plate 30 as described hereinbelow.

Figure 3:
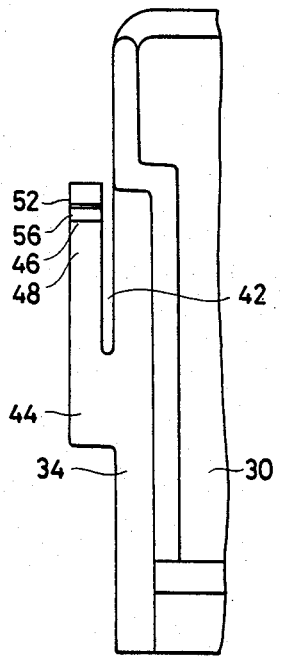
FIG. 3 is a plan view illustrating one side of the shelf plate.
Figure 4:
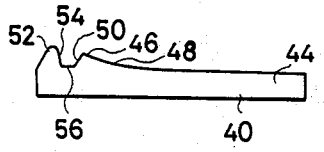
FIG. 4 is a side view of a leaf spring portion of the shelf plate.

Turning now to FIGS. 3 and 4, details of the side of shelf plate 30 and the leaf spring portion 40 are better illustrated. In the preferred embodiment, shelf plate 30 is molded of synthetic resin, and includes the stand-up portion 32 formed on its inner end, an inserted portion 36 (i.e., a portion of the shelf plate 30 to be received inside the insertion slot 12) that is somewhat upwardly curved, and an outwardly projecting portion 38 which extends substantially straight to the free end of shelf plate 30. Although plate 30 is slightly curved, as noted above, its upper surface can be considered generally planar.

The inserted portion 36 is provided along both sides (only one lateral side is shown in FIG. 3) with leaf spring portions 40 integrally molded with shelf plate 30 so that each of leaf spring portions 40 is connected only at its base portion 44 to the corresponding side edge 34, thereby forming a notch 42. Leaf spring portion 40 extends in a direction opposite to that in which the shelf plate 30 is inserted through slot 12, and a free end thereof extends outwardly beyond the outer end of the inserted portion 36.

On the top surface of leaf spring portion 40 is formed a first projection 46 which is defined by a gentle slope 48 facing toward base portion 44 and a steep slope or first stepped portion 50 facing toward its free end. Formed on the same surface as first projections 46 is a second projections 52 having a steep sloped second stepped portion 54 that confronts the first stepped portion 50, thereby defining between both projection 46 and 52, a groove 56 (the distance from groove 56 to a tip of base portion 44 of leaf spring portion 40 corresponds substantially to that of "U"-shaped portion 18 of upper frame 14).

After shelf plate 30 is inserted through insertion slot 12, the associated locking edge 24 of upper frame 14 is engaged in groove 56 and, in this condition, second projection 52 formed on the free end of leaf spring portion 40 functions as manipulating means by which a force can be exerted on leaf spring portion 40 from the outside of locking edge 24, for purposes of disengaging the groove from the locking edge to facilitate removal of shelf plate 30.

With the mounting mechanism constructed as described hereinabove, mounting and dismounting of shelf plate 30 is carried out in a manner as will be described. First, in mounting shelf plate 30, leaf spring portions 40 that are integral with shelf plate 30 are progressivley depressed by engagement of the respective gentle slopes 48 by the associated locking edges 24, as the inserted portion 36 of shelf plate 30 is inserted into insertion slot 12 of the office machine's body 10. In consequence, leaf spring portions 40 are elastically bent downwards, allowing the first projections 46 to ride across the associated locking edges 24. Immediately after the first projections 46 have ridden across the respective locking edges 24, leaf spring portions 40 are biased under their own elastically to restore to their original positions and, as a result, the respective locking edges 24 engage in the associated grooves 56.

Any further insertion of shelf plate 30 is prevented by the second stepped portions 54 of the associated leaf spring portions 40 abutting against the corresponding locking edges 24, and shelf plate 30 is kept from falling off by the respective first stepped portions 50 coming into engagement with the associated locking edges 24. Thus, shelf plate 30 is anchored in a predetermined position through engagement of the respective locking edges 24 with both stepped portions 50, 54.

In dismounting shelf plate 30, the free ends or the second projections 52 of the respective leaf spring portions 40 which are exposed outside of the respective locking edges 24 are forced so as to bend leaf spring portions 40 in a direction to disengage both projections 46, 52 from their associated locking edges 24. The engagement of the first stepped portions 50 with associated locking edges 24 is thereby released, so that shelf plate 30 may now be pulled to draw it out of the office machine's body 10, through insertion slot 12.

Although the preferred embodiment of the present invention has been described and illustrated showing leaf spring portion 40 as having two stepped portions 50, 54 defined by two projections 46, 52, respectively, these two stepped portions may also be defined merely by forming a groove in a planar plate on the top surface of leaf spring portion 40. Further, the embodiment has been illustrated showing two stepped portions 50, 54 which serve to anchor shelf plate 30 in opposite directions at a predetermined position. However, second stepped portion 54 may be replaced by suitable other positioning means or even eliminated. In any case, such a feature is not essential to the broader aspects of the present invention.

It will be apparent that shelf plate 30 may be provided with only a single leaf spring portion 40 on one side, rather than on both sides, as illustrated and described hereinabove. These and other modifications will be apparent to those skilled in the art within the scope of the claims that follow; the invention defined by the claims is in no way intended to be limited by the description of the preferred embodiments nor by such other modifications as have been described above.

The embodiments of the invention in which an exclusive property or privilege is claimed are defined as follows:

I claim:

1. A shelf plate adapted to be mounted in an insertion slot formed through a body of an office machine, the insertion slot including locking edge, comprising a plate having a generally planar surface including a an integral leaf spring portion formed along at least one lateral side thereof, the leaf spring portion extending in a direction opposite to that in which the plate is inserted into the body of the office machine and being laterally offset from a main part of the plate by a notch; the leaf spring portion being elastically displaced by the locking edge of the insertion slot during insertion of the plate into the slot; the leaf spring portion including a first stepped portion formed on its surface, which is adapted to engage with the locking edge of the insertion slot upon full insertion of the plate into the insertion slot; and a free end of the leaf spring portion functioning as a manipulator on which a force can be exerted to disengage the first stepped portion of the leaf spring portion from the locking edge for removal of the shelf plate from the insertion slot.

2. The shelf plate according to claim 1, wherein the leaf spring portion is formed on both sides of the plate.

3. The shelf plate according to claim 1, wherein the leaf spring portion includes a second stepped portion formed thereon adjacent its extending end, the first and the second stepped portions together defining a groove adapted to engage the locking edge of the insertion slot upon full insertion of the shelf plate into the insertion slot of the office machine.

* * * * *

UNITED STATES PATENT AND TRADEMARK OFFICE

CERTIFICATE OF CORRECTION

PATENT NO. : 4,749,091

DATED : June 7, 1988

INVENTOR(S) : Tomio Honma

It is certified that error appears in the above-identified patent and that said Letters Patent is hereby corrected as shown below:

Column 1, line 64, "side" should be --sides--.

Column 2, line 67, "projections" should be --projection--.

Column 2, line 68, "projections" should be --projection--.

Column 3, line 20, "progressivley" should be --progressively--.

Column 3, line 30, "elastically" should be --elasticity--.

Column 4, line 27, insert --a-- after including.

Column 4, line 28, delete --a-- after including.

Signed and Sealed this

Twenty-second Day of November, 1988

*Attest:*

DONALD J. QUIGG

*Attesting Officer*

*Commissioner of Patents and Trademarks*